US010023352B2

(12) United States Patent
Lipp

(10) Patent No.: US 10,023,352 B2
(45) Date of Patent: Jul. 17, 2018

(54) CONTAINER PRODUCED FROM A SINGLE-LAYERED, HELICALLY BENT SHEET-METAL STRIP

(71) Applicant: Xaver Lipp, Ellwangen (DE)

(72) Inventor: Xaver Lipp, Ellwangen (DE)

( * ) Notice: Subject to any disclaimer, the term of this patent is extended or adjusted under 35 U.S.C. 154(b) by 0 days.

(21) Appl. No.: 14/429,034

(22) PCT Filed: Jun. 13, 2013

(86) PCT No.: PCT/EP2013/001741
§ 371 (c)(1),
(2) Date: Mar. 18, 2015

(87) PCT Pub. No.: WO2014/048515
PCT Pub. Date: Apr. 3, 2014

(65) Prior Publication Data

US 2015/0274352 A1 Oct. 1, 2015

(30) Foreign Application Priority Data

Sep. 26, 2012 (DE) ..... 10 2012 018 935

(51) Int. Cl.
*B65D 8/00* (2006.01)
*B65D 6/32* (2006.01)
(Continued)

(52) U.S. Cl.
CPC ..... *B65D 7/04* (2013.01); *B21C 37/122* (2013.01); *B65D 7/38* (2013.01); *B65D 7/46* (2013.01);
(Continued)

(58) Field of Classification Search
CPC ..... B65D 7/04; B65D 7/46; B65D 7/38
(Continued)

(56) References Cited

U.S. PATENT DOCUMENTS 630,636 A * 8/1899 Sundh ..... H01B 7/226 138/131
970,885 A * 9/1910 Clemmer ..... E04D 1/22 52/529
(Continued)

FOREIGN PATENT DOCUMENTS

AT 374 877 B 6/1984
AT 374877 B * 6/1984 ..... B65D 88/005
(Continued)

*Primary Examiner* — Andrew Perreault
(74) *Attorney, Agent, or Firm* — Wenderoth, Lind & Ponack, L.L.P.

(57) ABSTRACT

A container is produced from a single-layered, helically bent sheet-metal trip (20). A first, helically running peripheral portion (22) of the sheet-metal strip (20) is bent out in the direction of the outside of the container (10) to form a helically running bent out edge (24). A second, helically extending peripheral portion (26) of the sheet-metal strip (20) overlaps a third portion (28) of the sheet-metal strip (20) on the inside of the container (10). The third portion is adjacent to the bent-out edge (24) and extends in the direction of the second peripheral portion (26) from the bent out edge (24). The second peripheral portion (26) is connected in a fluid-tight manner to the third portion (28) of the sheet-metal strip (20) on the inside of the container (10).

15 Claims, 3 Drawing Sheets

(51) Int. Cl.

| | |
|---|---|
| ***B65D 6/38*** | (2006.01) |
| ***B65D 88/08*** | (2006.01) |
| ***B65D 90/02*** | (2006.01) |
| ***B65D 90/08*** | (2006.01) |
| ***E04H 7/30*** | (2006.01) |
| ***B21C 37/12*** | (2006.01) |
| ***E04H 7/06*** | (2006.01) |

(52) U.S. Cl.
CPC ..... *B65D 88/08* (2013.01); *B65D 90/029* (2013.01); *B65D 90/08* (2013.01); *E04H 7/06* (2013.01); *E04H 7/30* (2013.01)

(58) Field of Classification Search
USPC ..... 206/524.6
See application file for complete search history.

(56) References Cited

U.S. PATENT DOCUMENTS 1,366,621 A * 1/1921 Wood ..... B31C 3/00 138/150
1,913,390 A * 6/1933 Hungerford ..... F16L 11/16 138/135
2,751,672 A * 6/1956 Reed ..... B21C 37/12 220/565
2,852,110 A * 9/1958 Dueringer ..... A01F 25/16 29/429
3,094,147 A * 6/1963 Nemer ..... F16L 11/16 138/122
3,122,115 A * 2/1964 Siegwart ..... B21C 37/121 138/154
3,204,666 A * 9/1965 Lindsay ..... F16L 59/153 138/135
3,263,321 A * 8/1966 Lombardi ..... B21C 37/123 138/154
3,276,171 A * 10/1966 Brown ..... E04B 7/102 29/433
3,359,822 A * 12/1967 Hurlow ..... F16C 1/26 138/134
3,380,147 A * 4/1968 McDonald ..... B21C 37/12 228/145
3,455,584 A * 7/1969 Henrickson ..... F16L 21/06 138/154
3,664,072 A * 5/1972 Lieckfeld ..... B65D 90/205 138/154
3,682,203 A * 8/1972 Foti ..... F16L 11/16 138/135
3,938,558 A * 2/1976 Anderson ..... B21C 37/121 138/122
4,074,847 A * 2/1978 McFatter ..... B23K 9/0325 228/145
4,142,284 A * 3/1979 Steuber ..... B21C 37/12 29/417
4,171,599 A * 10/1979 Lipp ..... B21C 37/101 52/528
4,282,398 A * 8/1981 Solomon ..... H01B 7/226 138/101
4,473,164 A * 9/1984 Lorenzen ..... B65D 7/04 220/4.04
4,630,650 A * 12/1986 Davis ..... F16L 11/16 138/129
4,718,965 A * 1/1988 Finsterwalder ..... E01D 19/16 14/22
4,821,501 A * 4/1989 Lipp ..... D07B 7/14 242/441.3
5,065,553 A * 11/1991 Magid ..... E04D 13/1407 52/409
5,259,166 A * 11/1993 Carey, II ..... E03B 3/02 29/507
D420,284 S * 2/2000 Sagel ..... D9/428
6,311,736 B2 * 11/2001 Herman ..... F16L 11/16 138/131
6,508,277 B1 * 1/2003 Imes ..... F16L 11/16 138/109
6,543,488 B2 * 4/2003 Foti ..... F16L 11/16 138/129
7,685,715 B2 * 3/2010 Rule ..... C12G 1/0213 165/136
7,765,763 B2 * 8/2010 Teng ..... E04D 1/26 52/413
2004/0163351 A1 * 8/2004 Rood, Jr. ..... E04D 3/364 52/528
2005/0204674 A1 * 9/2005 Marshall ..... E04D 3/364 52/544
2006/0208489 A1 * 9/2006 Wallace ..... B65D 88/08 285/424

FOREIGN PATENT DOCUMENTS

| | | | | |
|---|---|---|---|---|
| CA | 2 241 354 A1 | | 12/1999 | |
| DE | 27 22 227 | | 11/1978 | |
| DE | 199 39 180 A1 | | 2/2001 | |
| FR | 710 218 A | | 8/1931 | |
| GB | 628 765 A | | 9/1949 | |
| GB | 628765 A | * | 9/1949 | ..... F16L 11/24 |

* cited by examiner

CONTAINER PRODUCED FROM A SINGLE-LAYERED, HELICALLY BENT SHEET-METAL STRIP

FIELD OF THE INVENTION

The invention relates to a container produced from single-layered, helically bent sheet-metal strip.

BACKGROUND OF THE INVENTION

The production of such containers is known, for example, from EP 1 181 115 B1. A helix having a diameter corresponding to the container diameter is formed from a sheet-metal strip. The edges of the sheet-metal strip matched to one another are bent outwardly and subsequently connected to one another by a fold in a fluid-tight manner on the outside of the container. For this purpose, the longitudinal edges of the sheet-metal strip opposite one another are each bent outwardly in a U shape. Each of the U-shaped, outwardly bent edges of the sheet-metal strip matched to one another are placed one inside the other edge and subsequently connected permanently to one another by folds.

This method of production, known as Lipp-double-seam system, makes rapid and simple production of the containers having variable diameters and variable heights possible. By using transportable sheet-metal bending and mounting devices, the containers can be produced directly at the desired installation site.

A container produced from a helically bent sheet-metal strip is known from DE 199 39 180 A1. A first edge section is bent outward toward the outer side, while forming a helically outwardly bent edge. The second edge section of the sheet-metal strip is also bent outward and connected there to the first edge section by a fold.

A flexible metal hose is disclosed in U.S. Pat. No. 3,682,203 A, in which the folded edges of a sheet-metal strip are inserted one inside the other, and in this configuration, are slideable are relative to one another.

A fold connection for connecting the edges of a metal sheet is known from DE 27 22 227 C3, in particular a helically wound sheet-metal strip.

For many applications, for example for agriculture- and forestry-derived bulk materials or for organic waste, the containers produced have a sufficient tightness and media resistance. If a greater media resistance and/or tightness is desired, a correspondingly media-resistant material may be used for the material of the sheet-metal strip and/or the base of the fold situated on the inside of the container may be additionally sealed with a sealing thread.

SUMMARY OF THE INVENTION

The problem underlying the invention is to provide a container, which further expands the range of applications of such containers, in particular, continually and reliably meets the highest demands for cleanliness, media resistance and/or tightness.

The problem is basically solved by a container produced from a single-layered and helically bent sheet-metal strip. A first, helically extending edge section of the sheet-metal strip is bent toward the outer side of the container, while forming a helically extending outwardly bent edge. The second edge section of the sheet-metal strip, also helically extending, overlaps a third edge section on the inside of the container adjacent to the outwardly bent edge and extends from the outwardly bent edge in the direction of the second edge section. The second edge section is connected in a fluid-tight manner to the third section of the sheet-metal strip on the inside of the container.

Due to a mechanically fixed and non-detachable fluid-tight connection on the inside of the container, that container meets the highest demands not only for tightness, but for sterility as well. Moreover, the range of applications of such containers is further expanded. The fluid-tight connection on the inside, for example, reliably prevents the formation of cavities, in which germs can grow. The use of galvanized flat metal sheets or flat metal sheets made of stainless steel may also ensure a high media resistance.

The outwardly bent first edge section in this case may extend diagonally and, in particular, in a direction transverse, i.e. at a right angle, to the preferably vertical longitudinal axis of the container. The extension of the outwardly bent first edge section may be more than five times, in particular, more than eight times, and preferably, more than ten times the thickness of the sheet-metal strip. The outwardly bent first edge section permits producing the container using bending and connecting devices placed on the bottom. The container is then formed continuously by turning and simultaneous lifting the flat metal sheets bent to form a helix. The outwardly bent first edge section enhances the mechanical stability of the container, because it reinforces the edges of the flat metal sheets.

In one embodiment, the second edge section is connected at its helically extending end edge directly to the third section of the sheet-metal strip in a fluid-type manner, in particular, at the end face of the metal sheet. In this way, the transition of the second edge section to the third edge section of the sheet-metal strip on the inside of the container is reliably sealed in a fluid-tight manner.

In one embodiment, the end edge of the second edge section forms a step extending diagonally and, in particular, in a direction transverse to the preferably vertical longitudinal axis of the container, for example, through the end face of the flat metal sheet. This arrangement provides a support surface for a connection, through which the production process is further simplified and, in addition, through which an extreme tightness of the connection may be ensured. This connection is particularly advantageous if the container is produced at the site provided for it, because, as a rule, the conditions existing at such a construction site for producing a tight seal are difficult.

In one embodiment, the fluid-tight connection is produced by a welded connection. In particular, in the case of a welded connection, a step formed by the second edge section extending diagonally and, in particular, in a direction transverse to the vertical axis of the container is particularly advantageous. In this way, the weld seam may be positioned on this step and, in this way, a dripping of material rendered soft or flowable by the welding is prevented. This connection ensures a permanently fluid-tight and high-strength welded connection.

In one embodiment the distance between the fluid-tight connection, in particular, a welded connection, and the outwardly bent edge is more than twice, in particular, more than three times and, preferably more than five times the thickness of the flat metal sheet. In one embodiment, the distance may also be more than eight times or even ten times the thickness or more. As a result of this distance, the tightness and mechanical stability of the connection site is further increased. In particular, no danger exists that the stability of the connection, in particular, the welded connection, will be reduced as a result of structural changes in the sheet-metal strip, which structural changes could be caused by the outward bending.

In one embodiment, the second edge section is bent in the interior of the container by an offset relative to a fourth section of the sheet-metal strip, adjoining the offset in the direction of the first edge section. In this way, the edge sections of the flat metal sheets matched to one another may be brought into contact with one another with no or with reduced mechanical stresses. Given a sufficient offset, a self-adjustment of the edges of the flat metal sheets matched to one another is produced. In particular, the edge section disposed above the fourth section, in particular, the associated outwardly bent edge, may be supported on the offset disposed between the second edge section and the fourth edge section. As a result, the production is further simplified, and the stability is increased. Also, a precision fit is ensured. The second edge section and/or the fourth section may extend in the form of a casing, in particular, cylindrically, about the vertical axis of the container.

In one embodiment, the radial displacement of the second edge section relative to the fourth section of the sheet-metal strip caused by the offset is less than 95%, in particular, less than 90% and, preferably, less than 85% of the thickness of the sheet metal strip. As a result, the two edge sections associated with one another undergo minimum elastic deformation during production of the container, and are then in pre-tensioned contact with one another. This arrangement results in an additional reinforcement of the container.

In one embodiment, the offset of the second edge section is disposed in the area or in the vertical direction at the level of the outwardly bent edge. This offset results in a seam extending helically on the outside of the container, which is formed between the outwardly bent edge of the first edge section and the second edge section, in particular, between the outwardly bent edge of the first edge section and the offset of the second edge section. A sealant may be introduced into this seam. For example, a silicone seam may be introduced at this point, sealing the connection point from the outside as well.

In one embodiment, a fifth section of the sheet-metal strip adjoining the outwardly bent edge in the direction of the second edge section is bent toward the outside of the container by an offset relative to a sixth section of the sheet-metal strip adjoining the additional offset in the direction of the second edge section. The second edge section may be connected in a fluid-tight manner to the fifth section bordered by the outwardly bent edge on the one hand, and the additional offset on the other hand. In this embodiment, the second edge section may be brought into contact with the fifth section on the inside of the container without being outwardly bent. The sixth section of the sheet-metal strip may coincide with the fourth section, and even with the second edge section. The additional offset may be formed at a very sharp angle of, for example, less than 30°, in particular, less than 20° and, preferably, less than 15°. As a result, a negative impact of structural changes at the site of the additional offset on the strength and rigidity of the container produced is further reduced.

The features mentioned in the description may be essential to the invention, in each case per se or in any arbitrary combination.

Other objects, advantages and salient features of the present invention will become apparent from the following detailed description, which, taken in conjunction with the annexed drawings, discloses preferred embodiments of the present invention.

BRIEF DESCRIPTION OF THE DRAWINGS

Referring to the drawings that form a part of this disclosure.

DETAILED DESCRIPTION OF THE INVENTION

Figure 1:
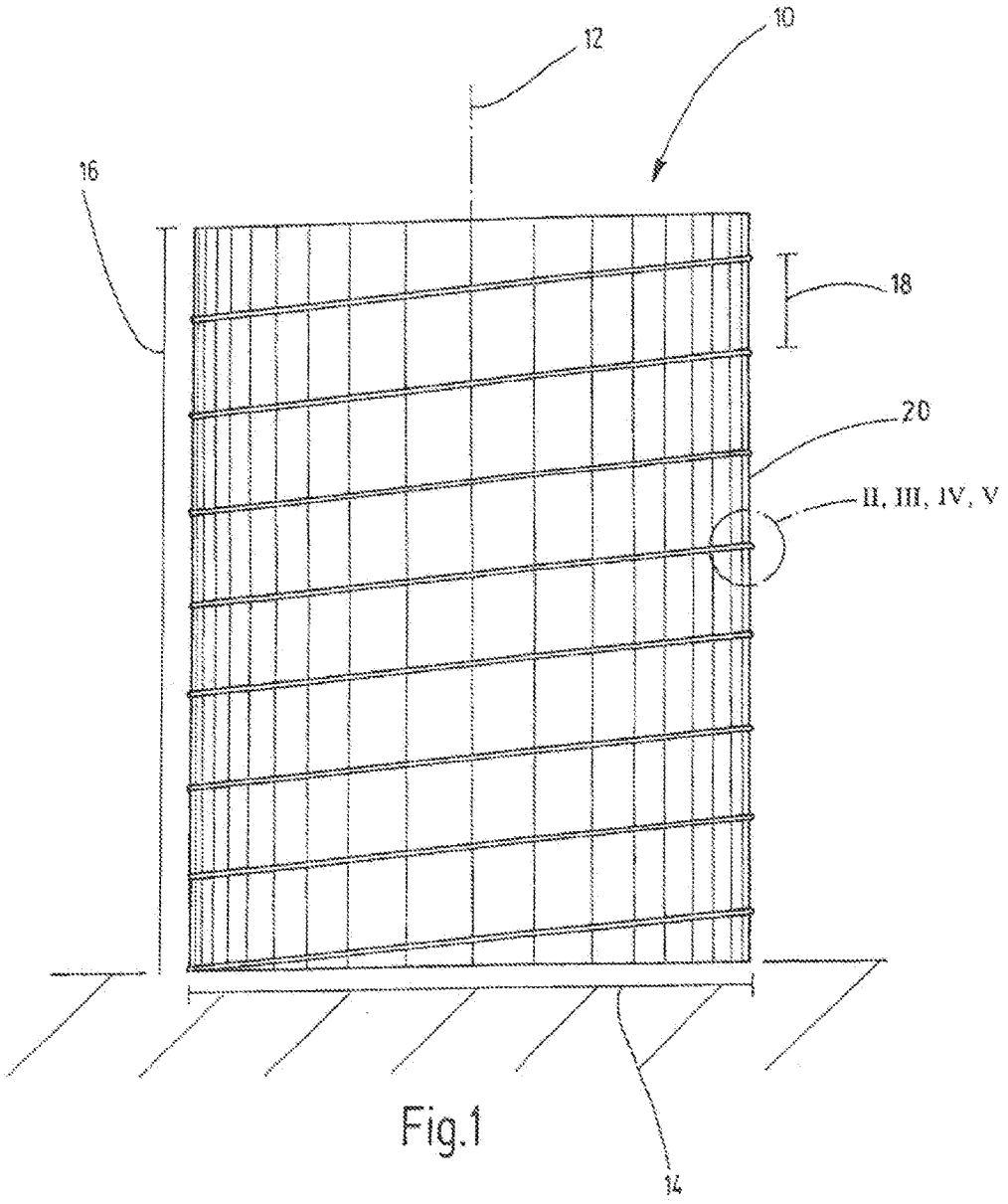
FIG. 1 is a side view of a container according to exemplary embodiments of the invention.

FIG. 1 shows a view of a container 10 according to the invention, as it may be used for storing agriculture- or forestry-derived bulk material, for example, grain, wood chips or organic waste, as well as for storing water, waste water or sludge, or also for storing gas. The container 10 is essentially cylindrical, in particular, plain or right circular cylindrical, on the outside and the inside, having a vertically oriented longitudinal axis 12.

The container 10 is produced by using a helically bent sheet metal strip 20, preferably directly at the installation site of the container 10. The diameter 14 of the container 10 may be between 4 m and 20 m or more. The height 16 of the container 10 may be between 2 m and 20 m or more. The volume capacity of the container 10 may be, for example, between 15 $m^3$ and 8,000 $m^3$. The preferably homogenous thickness 38 (FIG. 2) of the sheet-metal strip 20 is between 2 mm and 8 mm, in the present case, may be, in particular, more than 5 mm, preferably more than 6 mm and less than 12 mm, for example, between 8 mm and 10 mm. The width 18 of the sheet-metal strip 20 may be between 20 cm and 100 cm, in particular, between 30 cm and 80 cm, and, preferably, between 40 cm and 60 cm. In the exemplary embodiment illustrated, the width 18 of the sheet-metal strip 20 is approximately 50 cm.

Figure 2:
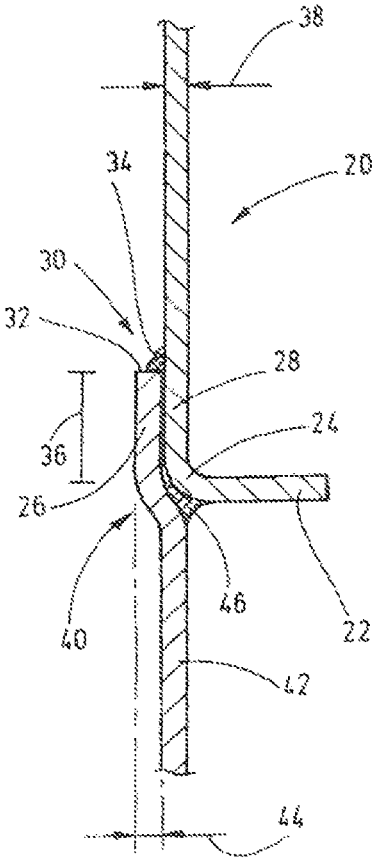
FIG. 2 is an enlarged partial side view in section through the connection point II of the container of FIG. 1 according to a first exemplary embodiment of the invention.

FIG. 2 shows an enlarged representation of a section through the connection point II of a first exemplary embodiment of the container 10 of FIG. 1. The first, vertically lower, edge section 22 of the helically extending flat metal sheet 20, is bent outwardly on the outside of the container 10 at a right angle relative to the longitudinal axis 12. An outwardly bent edge 24 also extends helically. The radial projection of the first edge section 22 in the exemplary embodiment is approximately six times the thickness 38 of the sheet-metal strip 20, but may, in particular, in the case of containers 10 having diameters of more than 8 m and, in particular, more than 10 m, also be more than eight times or more than ten times the thickness 38 of the sheet-metal strip 20.

The second edge section 26 of the sheet-metal strip 20 opposite the first edge section 22 also extends helically and. On the inside of the container 10, second edge section 26 overlaps a third section 28 of the sheet-metal strip 20. Third section 28 extends from the outwardly bent edge 24 in the direction of the second edge section 26 of the sheet-metal strip 20 disposed above the section depicted in FIG. 2. The second edge section 26 is connected in a fluid-tight manner on the inside of the container 10 to the third section 28 of the sheet-metal strip 20.

The connection is made in the exemplary embodiment by a welded connection 34. For this purpose, the front end of the second edge section 26, in particular, the edge end face of the sheet-metal strip 20, forms a step 32, which in the exemplary embodiment extends diagonally and in a direction transverse, i.e., at a right angle, to the longitudinal axis 12 of the container 10. The front end of the second edge section 26 may also be chamfered such that the front end surface of the second edge section 26, together with the third section 28 extending preferably in the form of a casing, may form a sharp angle of less than 90°. The welded connection 34 may then be safely applied in this area and, in particular, a dripping of material melted by the welding may be reliably prevented.

Moreover, the distance 36 between the fluid-tight connection, for example, the welded connection 34, and the outwardly bent edge 24, is structurally predefined as a result of the connection at the front end of the second edge section 26. In the exemplary embodiment, this distance is approximately five times, but may also be more than eight times or even more than ten times the thickness 38 of the sheet-metal strip 20.

The second edge section 26 is bent into the inside of the container 10 by an offset 40 relative to a fourth section 42 of the sheet-metal strip 20 adjoining the offset 40 in the direction of the first edge section 22 disposed below the section depicted in FIG. 2. For the offset 40, the sheet-metal strip 20 is bent at at least two points such that the unbent portions extend parallel to one another. In the exemplary embodiment, the second edge section 26 and the fourth section 42 of the sheet-metal strip 20 extend parallel to one another. These sections 26, 42, like the other sections of the sheet-metal strip 20, may extend essentially cylindrically and, primarily plain or right circular cylindrically, in relation to the longitudinal axis 12 of the container 10.

The radial displacement 44 of the second edge section 26 relative to the fourth section 42 of the sheet-metal strip 20 caused by the offset 40 may, in principle, be 100% or even more than 100% of the thickness 38 of the sheet-metal strip 20. In this case, a gap may form between the second edge section 26 and the third section 28, into which a connecting substance and/or a sealant may be introduced. In one embodiment, however, the radial displacement 44 is less than 100% of the thickness 38 of the sheet-metal strip 20, for example, approximately 90%. As a result, the second edge section 26 and/or the third section 28 are resiliently deflected and abut one another with a resilient pre-tensioning. In this case, there is no need to cover a gap between the second edge section 26 and the third section 28 by the connection, for example, the welded connection 34.

The offset 40 of the second edge section 26 is disposed in the area of the outwardly bent edge 24. As a result, the flat metal sheet extending in the area above the offset 40 is supported against the respective flat metal sheet extending below. A sealant 46, for example, a silicone seam, is introduced into the helically extending weld, which is formed on the outside between the outwardly bent edge 24 and the offset 40. This prevents moisture, for example, from entering the area between the second edge section 26 and the third section 28.

Figure 3:
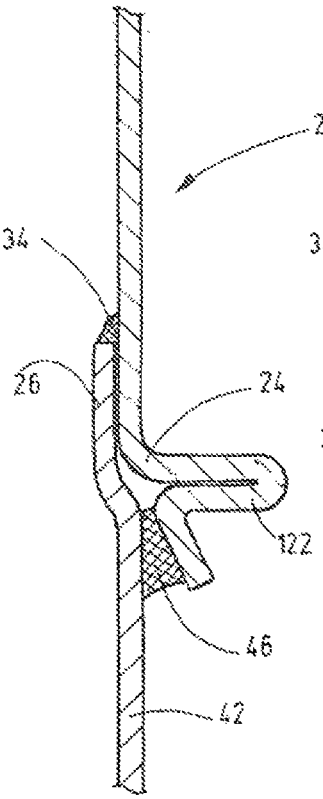
FIG. 3 is an enlarged, partial side view in section through a connection point III of the container of FIG. 1 according to a second exemplary embodiment of the invention.

FIG. 3 shows a section through the connection point III of a second exemplary embodiment of the container 10 of FIG. 1. The first edge section 122 is folded, forming a fold. The free end is subsequently bent outward at an angle of between 15° and 70°, in particular, between 20° and 45°, and in the exemplary embodiment, of approximately 30° relative to the longitudinal axis 12 of the container 10. The connection 46 is introduced into the area between the outwardly bent end section of the first edge section 112 and the fourth section 42. This configuration improves the run-off behavior of, for example, rainwater striking the outer surface of the container 10.

Figure 4:
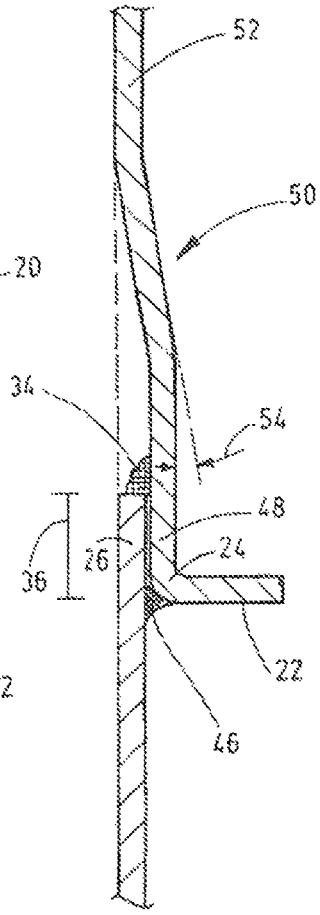
FIG. 4 is an enlarged, partial side view in section through a connection point IV of the container of FIG. 1 according to a third exemplary embodiment of the invention.

FIG. 4 shows a section through the connection point IV of a third exemplary embodiment of the container 10 of FIG. 1. A third or fifth section 48 of the sheet-metal strip 20 adjoining the outwardly bent edge 24 in the direction of the second edge section 26 is bent toward the outside of the container 10 by an additional offset 50 relative to a sixth section 52 of the sheet-metal strip 20 adjoining the additional offset 50 in the direction of the second edge section 26. The second edge section 26 is connected in a fluid-tight manner to the fifth section 48, in the exemplary embodiment, by the welded connection 34.

The angle 54 of the additional offset 50 is less than 45°, in particular, less than 30° and, preferably, less than 20°. In the exemplary embodiment, the angle 54 is approximately 10°. As a result, the structural changes at the outwardly bent points of the sheet-metal strip 20 are reduced. The radial projection of the fifth section 48 relative to the sixth section 52 in the exemplary embodiment is somewhat more than 100% the thickness 38 of the sheet-metal strip 20, so that the fifth section 48 loosely abuts the second edge section 26. In an alternative embodiment, the radial projection of the additional offset 50 may also be 100% of the thickness 38 of the sheet-metal strip 20, or also less than 95%, in particular, less than 90% and, preferably less than 85%, as described in connection with the offset 40 of the first and second exemplary embodiment. A self-adjusting and/or resiliently clamping contact of the fifth section 48 to the second edge section 26 is then formed.

The second edge section 26 is aligned on the inside of the container 10 with the inner wall of the container 10 formed by the sixth section 52. In the third exemplary embodiment, in particular, bending is not required for the second edge section 26 relative to an adjacent section of the sheet-metal strip 20, for example, relative to the fourth section 42 of the first and second exemplary embodiment. Associated structural changes are reliably avoided as a result.

Figure 5:
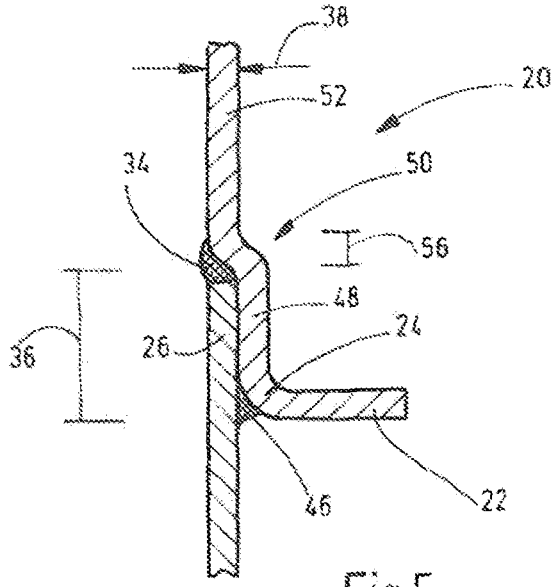
FIG. 5 is an enlarged, partial side view in section through a connection point V of the container of FIG. 1 according to a fourth exemplary embodiment of the invention.
Figure 6:
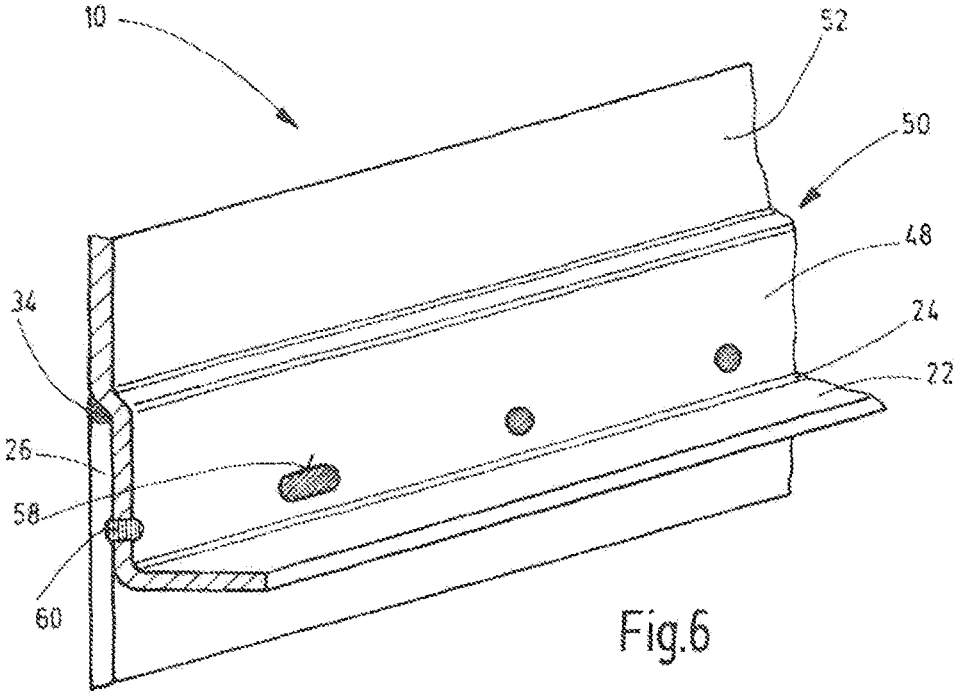
FIG. 6 is a perspective view of the outside of the container of FIG. 1 in the area of the connection point of FIG. 5.

FIG. 5 shows a section through a connection point V of a fourth exemplary embodiment of the container 10 of FIG. 1. FIG. 6 shows a perspective view from the outside of a container 10 sectioned in the area of the connection point according to FIG. 5.

A fifth section 48 of the sheet-metal strip 20 adjoining the outwardly bent edge 24 in the direction of the second edge section 26 is bent toward the outside of the container by an additional offset 50 relative to a sixth section 52 of the sheet-metal strip 20 adjoining the additional offset 50 in the direction of the second edge section 26. Aside from the additional offset 50, the fifth section 48 of the third and fourth exemplary embodiments of FIG. 4 and FIG. 5 corresponds to the third distance of the first and second exemplary embodiments of FIG. 2 and FIG. 3. The second edge section 26 is connected in a fluid-tight manner to the fifth section 48 on the inside of the container 10, in the exemplary embodiment, by the welded connection 34.

In the exemplary embodiment, the fluid-tight connection in this case is disposed at the level of the offset 50, as a result of which the offset 50 undergoes additional mechanical stabilization.

The angle 54 of the additional offset 50 is larger than in the third exemplary embodiment of FIG. 4. In particular, the angle is greater than 30°, in particular, greater than 35° and less than 70°, and preferably greater than 35° and less than 60°. The length 56 of the additional offset 50 is less than 400% of the thickness 38 of the sheet-metal strip 20, in particular, less than 400%, and preferably less than 300%. In the exemplary embodiment, the length 56 of the additional offset 50 is more than 150% and less than 250% of the thickness 38 of the sheet-metal strip 20.

The distance 36 of the additional offset 50 from the outwardly bent edge 24 in the exemplary embodiment is more than twice and less than ten times, in particular, more than three times and less than eight times, preferably more than four times and less than six times the thickness 38 of the sheet-metal strip 20. Moreover, the distance 36 of the additional offset 50 from the outwardly bent edge 24 is more than 50% and/or less than 250%, in particular, more than 70% and/or less than 200%, and preferably, more than 80% and/or less than 150% of the radial extension of the outwardly bent first edge section 22.

The radial projection of the fifth section 48 in the exemplary embodiment relative to the sixth section 52 is somewhat more than 100% of the thickness 38 of the sheet-metal strip 20, so that the fifth section 48 loosely abuts the second edge section 26. In an alternative embodiment, the radial projection of the additional offset 50 may also be 100% of the thickness 38 of the sheet-metal strip 20 or also, as described in connection with the offset 40 of the first and second exemplary embodiments, less than 95%, in particular, less than 90%, and preferably less than 85%, so that a self-adjusting and/or resiliently clamping contact of the fifth section 48 to the second edge section 26 is formed.

The second edge section 26 is aligned on the inside of the container 10 with the inner wall of the container 10 formed by the sixth section 52. In the fourth exemplary embodiment of FIG. 5, in particular, bending not required for the second edge section 26 relative to an adjacent section of the sheet-metal strip 20, in particular, relative to the sixth section 52.

As is apparent from the perspective view of FIG. 6, the connection between the second edge section 26 and the fifth section 48 is stabilized by additional connection points 60. The additional connection points 60 may be produced, for example, by spot welds. The contour 58 of the additional connection points 60 may, for example, be implemented as essentially circular or oblong. The additional connection points 60 may be disposed equidistantly in the circumferential direction about the container 10, for example, at a distance, which is more than five times and/or less than 20 times, in particular, more than eight times and/or less than 30 times, and preferably, more than twelve times and/or less than 25 times the thickness 38 of the sheet-metal strip 20.

While various embodiments have been chosen to illustrate the invention, it will be understood by those skilled in the art that various changes and modifications can be made therein without departing from the scope of the invention as defined in the claims.

What is claimed is:

1. A container, comprising:

a single layered, helical sheet-metal strip wound circumferentially about and axially along a longitudinal axis in three dimensions and defining a curve traced on a cylinder by rotation of a point crossing right sections thereof at a constant oblique angle;

a helically extending first edge section of said sheet-metal strip bent radially outwardly relative to said longitudinal axis forming a helically extending radially outwardly bent edge of said sheet-metal strip;

a helically extending second edge section of said sheet-metal strip overlapping a helically extending third edge section of said sheet-metal strip on an inside of the container adjacent to said radially outwardly bent edge, said third edge section extending from said outwardly bent edge in a direction of said second edge section, said second edge section being connected by a fluid-tight weld to said third edge section on an inside of the container; and a sealant in a helically extending seam on an outside of the container, said seam being formed between said outwardly bent edge of said first edge section and an offset of said second edge section, said sealant including silicone.

2. A container according to claim 1 wherein said second edge section comprises a helically extending end edge connected fluid-tight to said third edge section of said sheet-metal strip.

3. A container according to claim 1 wherein said second edge section comprises helical end edge forming a step on the inside of the container and extending diagonally relative to said longitudinal axis.

4. A container according to claim 3 wherein said end edge extends transversely relative to said longitudinal axis.

5. A container according to claim 1 wherein said second and third edge sections are directly connected by said weld.

6. A container according to claim 1 wherein said fluid-tight weld is spaced a distance from said outwardly bent edge that is more than twice a thickness of said sheet-metal strip.

7. A container according to claim 6 wherein said distance is more than three times said thickness.

8. A container according to claim 6 wherein said distance is more than five times said thickness.

9. A container according to claim 1 wherein said second edge section is bent into the inside of the container by an offset relative to a fourth section of said sheet-metal strip, said fourth section adjoining said offset in a direction of said first edge section.

10. A container according to claim 9 wherein a displacement of said second edge section relative to said fourth section by said offset is less than 95 percent of a thickness of said sheet-metal strip.

11. A container according to claim 10 wherein said displacement is less than 90 percent of the thickness.

12. A container according to claim 10 wherein said displacement is less than 85 percent of the thickness.

13. A container according to claim 10 wherein said offset is at a level of said outwardly bent edge.

14. A container according to claim 9 wherein said offset is at a level of said outwardly bent edge.

15. A container according to claim 1 wherein said third section of said sheet-metal strip is toward an outside of the container relative to a sixth section of said sheet-metal strip by an offset in the direction of said second edge section adjoining said offset in the direction of said second end section; and said fluid-tight weld is bordered by said outwardly bent section and said offset.

* * * * *